US009370941B2

(12) United States Patent
Rae et al.

(10) Patent No.: US 9,370,941 B2
(45) Date of Patent: Jun. 21, 2016

(54) HOUSING FOR INK CURING APPARATUS

(75) Inventors: Malcolm Rae, Redhill Surrey (GB); James Hicks, Redhill Surrey (GB)

(73) Assignee: GEW (EC) LIMITED, Redhill Surrey (GB)

( * ) Notice: Subject to any disclaimer, the term of this patent is extended or adjusted under 35 U.S.C. 154(b) by 0 days.

(21) Appl. No.: 14/237,140

(22) PCT Filed: Aug. 6, 2012

(86) PCT No.: PCT/GB2012/051898

§ 371 (c)(1),
(2), (4) Date: Jun. 6, 2014

(87) PCT Pub. No.: WO2013/021184

PCT Pub. Date: Feb. 14, 2013

(65) Prior Publication Data

US 2014/0292970 A1 Oct. 2, 2014

(30) Foreign Application Priority Data

Aug. 8, 2011 (GB) ..... 1113676.9

(51) Int. Cl.
*B41J 11/00* (2006.01)
*B41F 23/04* (2006.01)

(52) U.S. Cl.
CPC ..... *B41J 11/0015* (2013.01); *B41F 23/04* (2013.01); *B41F 23/0409* (2013.01); *B41F 23/0483* (2013.01)

(58) Field of Classification Search
CPC ..... B41J 2002/17516; B41J 2/175
See application file for complete search history.

(56) References Cited

U.S. PATENT DOCUMENTS

| | | | | |
|---|---|---|---|---|
| 5,060,125 | A | 10/1991 | Cowie et al. | |
| 6,646,278 | B1 * | 11/2003 | Schwarz et al. | 250/504 R |
| 2004/0070975 | A1 * | 4/2004 | Register et al. | 362/284 |

FOREIGN PATENT DOCUMENTS

| | | | |
|---|---|---|---|
| EP | 1 977 895 | A1 | 10/2008 |
| EP | 2 447 070 | A1 | 5/2012 |
| GB | 2 468 703 | A | 9/2010 |
| WO | WO2013/128165 | * | 9/2013 |

* cited by examiner

*Primary Examiner* — An Do
*Assistant Examiner* — Renee I Wilson
(74) *Attorney, Agent, or Firm* — Nixon Peabody LLP; David S. Resnick; Mark J. FitzGerald

(57) ABSTRACT

A double-walled housing (3) for an ultra-violet ink curing apparatus (1), comprising an inner skin (5) and an outer wall (7) secured together by at least one locking means (9), wherein the locking means (9) is adapted to secure the inner skin (5) and the outer wall (7) together while permitting relative movement of the inner skin (5) along the length of the outer wall (7).

7 Claims, 3 Drawing Sheets

HOUSING FOR INK CURING APPARATUS

CROSS REFERENCE TO RELATED APPLICATIONS

This application is a 35 U.S.C. 371 National Stage Application of International Application No. PCT/GB2012/051898, filed Aug. 6, 2012, which designates the United States, and which claims the benefit of foreign priority under 35 U.S.C. 119 of GB Application No. 1113676.9 filed Aug. 8, 2011, the contents of which are herein incorporated by reference in their entireties.

The present invention relates to an improved housing for a UV light source and cooling system of an ink curing apparatus.

Ink curing apparatus, comprising a housing and a lamp partially surrounded by reflectors to direct UV light onto a substrate to cure ink, are well-know. The apparatus often comprises an extruded housing, which is use, houses the lamp and has reflectors and a cooling system. The cooling system comprises an air exhaust and/or water cooling means to compensate for the intense heat emitted from the lamp.

The lamp housing can be provided in the form of an interchangeable cassette, which slides into and out of a casing in the ink curing apparatus. It is also known to provide such a cassette with a double-skinned wall, which provides an air passage around the walls of the housing. In such "double-walled" devices, the parallel walls are co-extruded and so are permanently fixed together. Although there are advantages in integrally forming the walls, it is complex and costly to machine the components of the apparatus along the length of the housing during manufacture. When the double-skinned housing is integrally formed, this also results in distortion of the housing during use because the inner wall absorbs a greater proportion of the intense heat created than the outer wall. The heat causes the inner wall to expand and distort because it is permanently fixed to the outer wall.

Existing integrally-formed, double-skinned housings are axially locked together. The removal of the lamp housing from the apparatus requires removal of the entire cassette. The removal of the entire cassette makes replacement and repair of the lamp difficult because of the weight of the cassette, which has to be removed. Thus, the time, complexity and cost of maintenance are increased.

The present invention sets out to provide an improved housing for an ink curing apparatus which alleviates the problems described above by providing a housing which allows for easier lamp maintenance and is relatively simple and cost-effective to produce.

Accordingly, in one aspect, the invention provides a double-walled housing for an ultra-violet ink curing apparatus, comprising an inner skin and an outer wall secured together by at least one locking means, wherein the or each locking means is adapted to secure the inner skin and the outer wall together whilst permitting relative movement of the inner skin along the length of the outer wall.

By providing a locking means, which prevents axial movement but allows longitudinal movement of the inner skin with respect to the outer wall, the housing allows for the expansion of the inner skin caused by heat created during UV curing/drying. It is to be understood that longitudinal movement refers to movement along the length of the housing and axial movement refers to movement along an axis extending from the inner skin to the outer wall.

Within the context of this specification the word "comprises" is taken to mean "includes, among other things". It is not intended to be construed as "consists of only". The term "skin" used to describe the innermost wall of the housing, which is closest to the lamp of the UV apparatus, is not limited to a flexible member, but is to be understood to refer to any wall substantially surrounding the UV apparatus.

Preferably, the or each locking means comprises at least one protrusion adapted to mate with a corresponding recess in each of the inner skin and the outer wall.

More preferably, the at least one protrusion is substantially cylindrical.

Preferably, the housing comprises an upper section and a lower section. The lower section houses at least one UV lamp and at least one reflector means, and the lamp and/or the reflector means are separable from the upper section and so are removable from the UV apparatus.

More preferably, the lamp and/or reflector means are slideable with respect to the upper section of the housing.

A lower section including a reflector/s that can be slideably removed from the upper section allows the lamp and reflectors to be conveniently removed from the housing for replacement and/or repair, whilst minimising the weight of the components of the apparatus which need to be removed.

Preferably, the housing further comprises at least one cooling means, wherein the or each cooling means comprises at least one channel within the housing.

More preferably, the or each channel is substantially parallel to the length of the housing.

A longitudinal channel/s allows, in use, for water cooling along the entire length of the apparatus. Efficient cooling of the housing improves the efficiency of the apparatus and also allows an operator to touch the outer surface of the housing without risk of injury.

Preferably, the housing comprises at least one channel adjacent to the or each reflector.

Efficient cooling of the reflectors improves the efficiency of the apparatus and reduces the required power input and running costs.

For the purposes of clarity and a concise description, features are described herein as part of the same or separate embodiments; however it will be appreciated that the scope of the invention may include embodiments having combinations of all or some of the features described.

The invention will now be described by way of example with reference to the accompanying diagrammatic drawings, in which.

Figure 1:
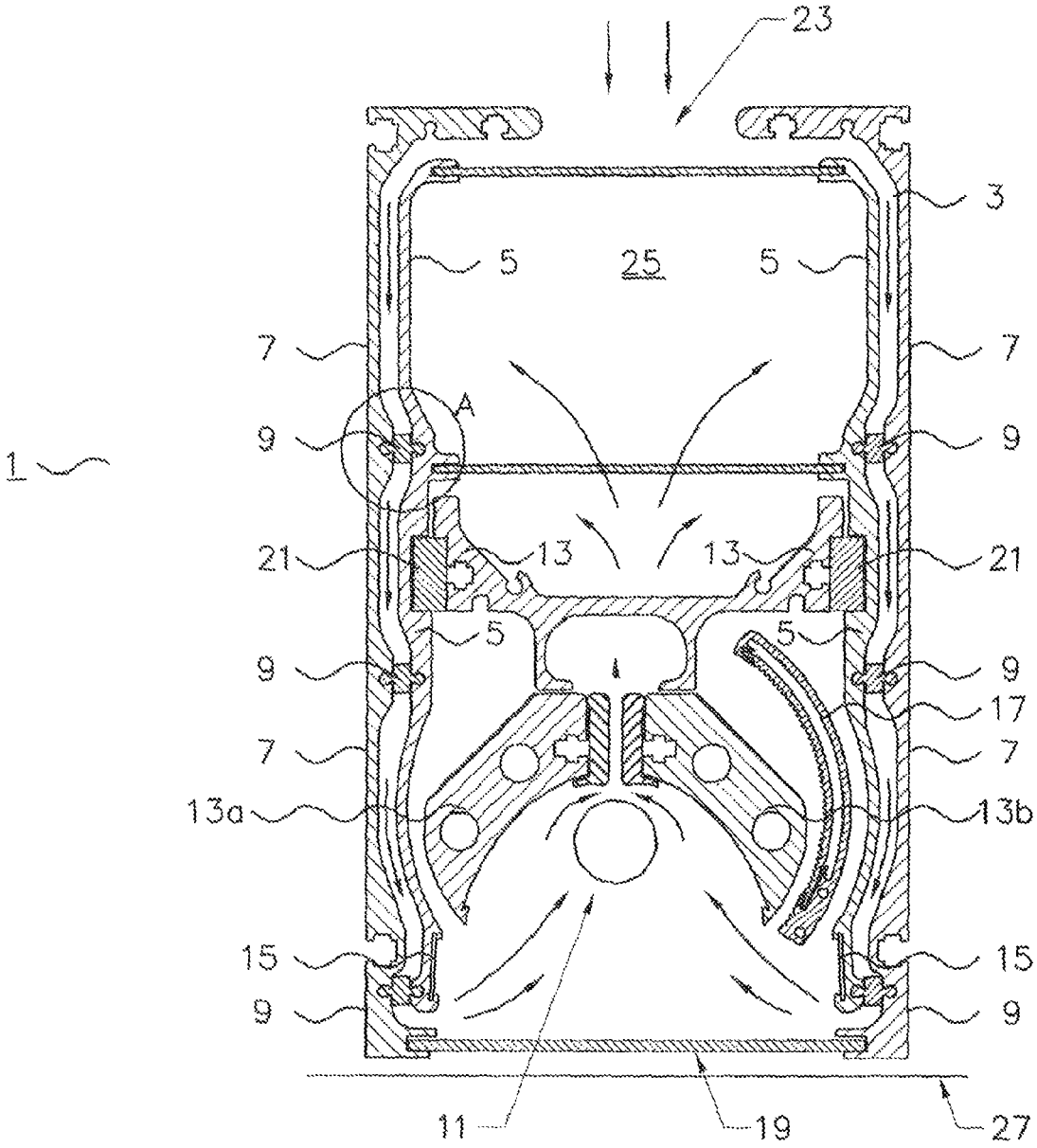
FIG. 1 is a cross-sectional view of an ink curing apparatus constructed in accordance with the present invention.
Figure 2:
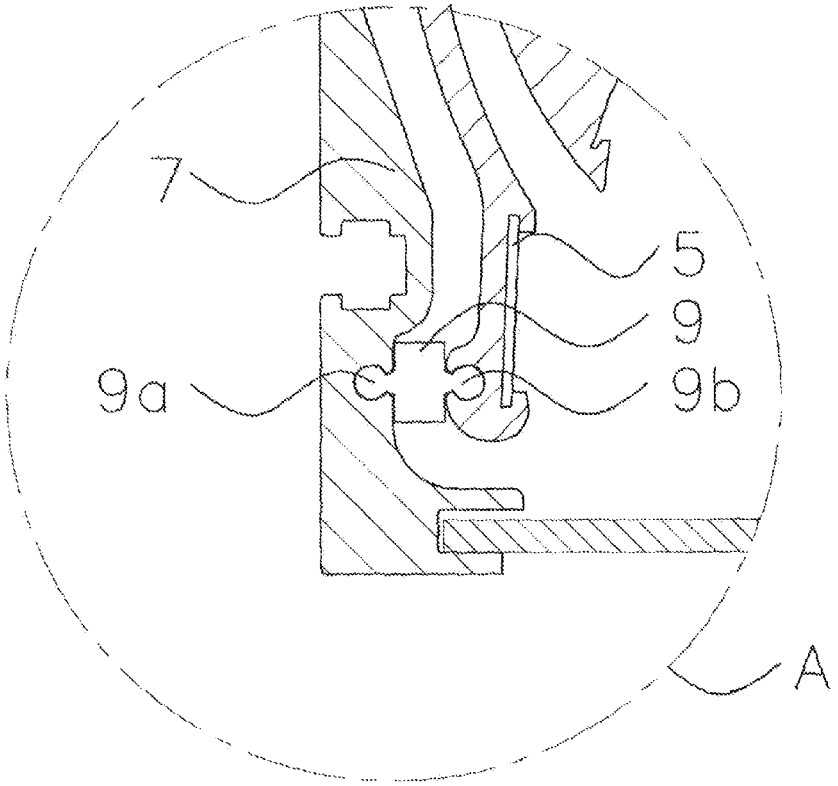
FIG. 2 is an enlarged view of area A marked on FIG. 1 showing the locking member.
Figure 3:
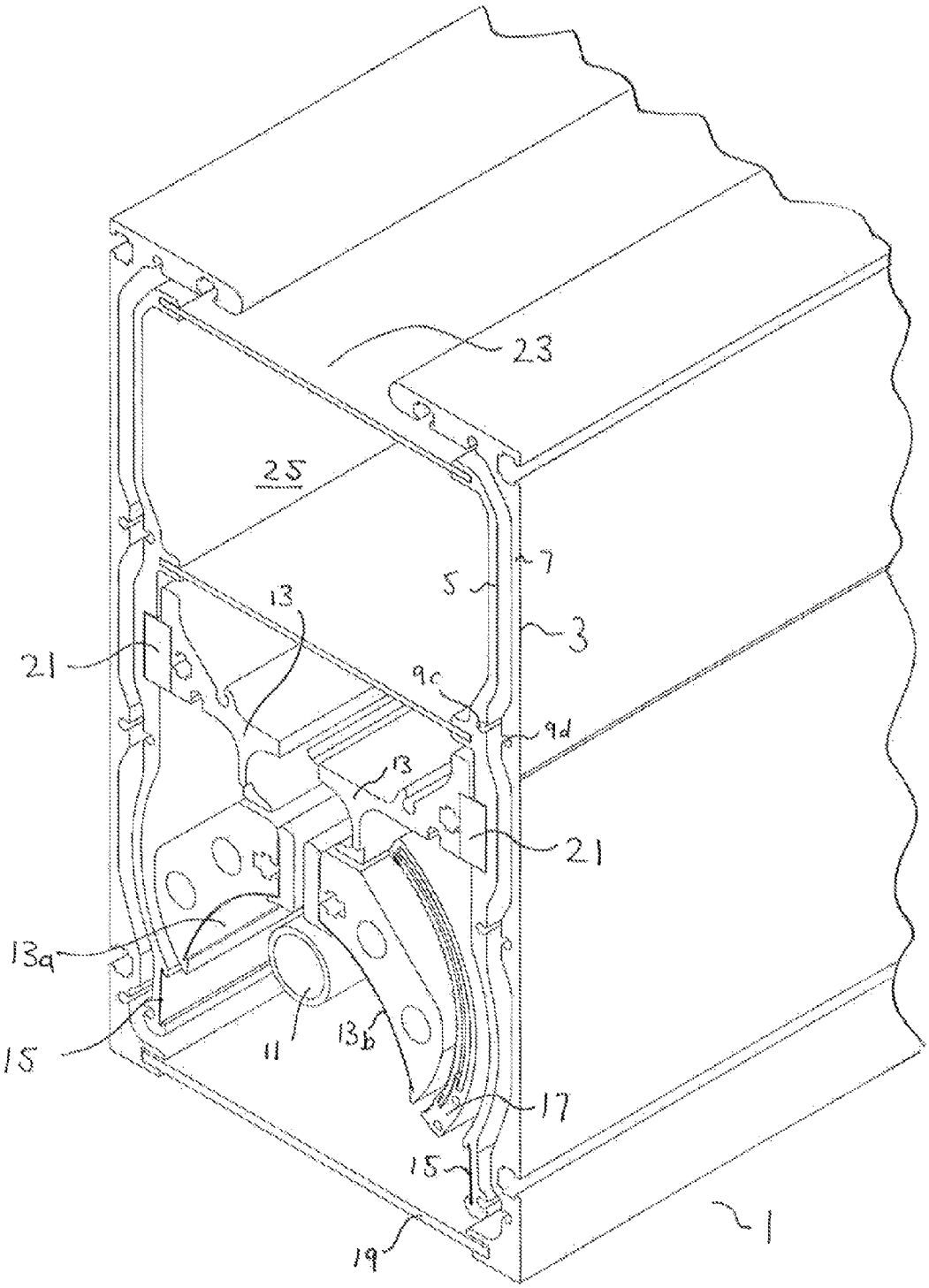
FIG. 3 is a perspective view from the side of the ink curing apparatus of FIG. 1.

Referring to FIGS. 1 and 3, the apparatus 1 comprises a double-skinned housing 3. The housing 3 comprises an inner skin 5 and an outer wall 7, which are extruded separately. The outer wall 7, in use, is locked to the inner skin 5 by multiple locking members 9. FIG. 1 shows the locking members 9 in position and FIG. 3 shows the housing 3 without the locking members in place. As shown in FIG. 2, the locking members 9 each comprise protrusions 9*a*, 9*b* which mate with corresponding recesses 9*c*, 9*d* in the inner skin 5 and the outer wall 7. The locking members 9 are shaped to allow longitudinal movement of the inner skin 5 within and along the length of the outer wall 7, whilst allowing air to flow along the full length of the apparatus 1 in the channel between the outer wall 7 and the inner skin 5.

FIG. 1 shows three locking members 9 along each side of the housing 3. Two locking members 9 secure the double walls of the lower section of the housing 3 together and a further locking member 9 secures the double wall of an upper section of the housing together. However, it is envisaged that the shape, number and positioning of the locking members 9 can vary depending on the size of the apparatus 1.

The lower section of the housing 3 is positioned in use over a substrate 27. The lower section 3 houses a UV lamp 11, partially surrounded by dichroic, coated UV reflectors 13*a*, 13*b* and further UV reflectors 15. The dichroic reflectors 13*a*, 13*h* are shaped to have fully elliptical geometry, which ensures that the highest possible peak power of UV radiation is returned and directed towards the substrate 27 during the curing process. The reflector supports 15 are extruded separately from the chassis piece 13. The reflectors 13*a*, 13*b* are made of an aluminium or glass material. The reflectors 13*a*, 13*b* can be water-cooled or air cooled or, as shown in the embodiment of FIG. 1, a combination of water-cooling and air-cooling is used.

A moveable shutter 17 is rotatable around the lamp 11 at the lower end of the apparatus 1 to shield the substrate from the UV lamp 11 when the apparatus 1 is not in use. When the shutter 17 is in the closed position the inner surface of the shutter 17 overlaps the outer surface of each of the dichroic reflectors 13*a*, 13*b*. A quartz window 19 is positioned below the housing 3 and the lamp 11. In use a substrate 27, which is to be cured, is placed below the quartz window 19.

The inner skin 5 and the outer wall 5 are fixed together by the locking members 9 with the channel created between them allowing for a free flow of air around the apparatus 1. Chassis sliders 21 are fixed to the chassis piece 13, as shown in FIG. 1. There are multiple chassis sliders 21 along the length of the housing 3. In use, the sliders 21 allow the lamp 11 and the chassis piece 13 with reflectors 13*a*, 13*b* to be removed, repaired and/or replaced for maintenance. When the required maintenance has been completed the chassis piece 13 can be easily and conveniently slid back into the housing 3 along the chassis sliders 21.

The upper section of the housing 3 comprises an opening 23, through which cooled, purged, filtered or ambient air enters the apparatus 1. The upper section also houses an air exhaust 25.

In use, a substrate 27 carrying ink for curing/drying is transported directly beneath the quartz window 19. Ultra-violet radiation from the UV lamp 11 is transmitted through the window 19 onto the substrate 27. The shutter 17 is in an open position and the reflectors 13*a*, 13*b* direct the UV light onto the substrate 27 for a period of time sufficient to cure/dry the ink on the substrate 27.

The UV lamp 11 emits heat at around 850 degrees Celsius and a portion of this infrared heat is absorbed by the surface of the reflectors 13*a*, 13*b*, and is then transmitted through the reflector supports 15. Heat is also absorbed by the inner skin 5 of the housing 3, which will expand. When the inner skin 5 of the housing 3 expands, the moveable locking members 9 allows the inner skin 5 to move within the outer wall 7, along the length of the housing 3. However, the locking members 9 prevent transverse movement of the inner skin 5 towards or away from the outer wall 7 of the housing 3.

As shown by the arrows in FIG. 1, in order to cool the hot surfaces of the apparatus 1, cool ambient air is drawn in through the opening 23 in the upper section of the housing 3 and pulled between the inner skin 5 and the outer wall 7 of the housing 3. As the cool air reaches the surface of the UV lamp 11 and the reflectors 13, 15 it is heated and drawn upwards between the dichroic reflectors 13 to the air exhaust 25. The hot air escapes from the apparatus 1 through the exhaust 25 taking with it a proportion of the heat created by the lamp 11. Thus, the apparatus 1 can be maintained at the desired operating temperature.

It is envisaged that, in alternative embodiments of the present invention, the reflectors 13, 15 are also water-cooled using a parallel system of water pipes. In such a system, cold water is passed through an inner channel in the pipe, over or through the reflector surface, before being reversed once heated and directed out of the apparatus via an outer channel, concentric with the inner channel of the pipe.

The above described embodiment has been given by way of example only, and the skilled reader will naturally appreciate that many variations could be made thereto without departing from the scope of the claims.

The invention claimed is:

1. A double-walled housing for an ultra-violet ink curing apparatus, comprising an inner skin and an outer wall secured together by an assembly comprising at least one protrusion adapted to mate with a corresponding recess in each of the inner skin and the outer wall, wherein the assembly is adapted to secure the inner skin and the outer wall together whilst permitting relative movement of the inner skin along the length of the outer wall, wherein the assembly prevents axial movement but allows longitudinal movement of the inner skin with respect to the outer wall.

2. The housing for an ultra-violet ink curing apparatus according to claim 1, wherein the at least one protrusion is substantially cylindrical.

3. The housing for an ultra-violet ink curing apparatus according to claim 1, further comprising at least one cooling channel within the housing.

4. The housing for an ultra-violet ink curing apparatus according to claim 3 wherein the channel is substantially parallel to the length of the housing.

5. The housing for an ultra-violet ink curing apparatus according to claim 4 wherein the housing member comprises at least one channel adjacent to a reflector of the curing apparatus.

6. The ultra-violet ink curing apparatus according to claim 1, wherein the housing comprises an upper section and a lower section, a lower section housing at least one UV lamp and at least one reflector, and wherein the lamp and/or the reflector are removable from the UV apparatus and separable from the upper section.

7. The ultra-violet ink curing apparatus according to claim 6 wherein the lamp and/or the reflector are slideable with respect to the upper section of the apparatus.

* * * * *